US007390195B2

(12) United States Patent
Liao

(10) Patent No.: US 7,390,195 B2
(45) Date of Patent: Jun. 24, 2008

(54) ELECTRICAL CONNECTOR WITH CONTACT TERMINAL

(75) Inventor: Fang-Jun Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/810,265

(22) Filed: Jun. 5, 2007

(65) Prior Publication Data

US 2007/0281554 A1 Dec. 6, 2007

(30) Foreign Application Priority Data

Jun. 5, 2006 (TW) ..... 95119839 A

(51) Int. Cl.
*H01R 12/00* (2006.01)

(52) U.S. Cl. ..... 439/66

(58) Field of Classification Search ..... 439/66, 439/862, 342, 83, 876, 733.1, 74
See application file for complete search history.

(56) References Cited

U.S. PATENT DOCUMENTS 5,984,693 A * 11/1999 McHugh et al. ..... 439/66
6,019,611 A * 2/2000 McHugh et al. ..... 439/71
6,296,495 B1 * 10/2001 Wang et al. ..... 439/71
6,585,527 B2 * 7/2003 Koopman et al. ..... 439/71
6,786,736 B2 * 9/2004 Flannery et al. ..... 439/66
6,821,163 B2 * 11/2004 McHugh et al. ..... 439/733.1
7,052,284 B2 * 5/2006 Liao et al. ..... 439/66
2007/0218764 A1 * 9/2007 Chang et al. ..... 439/607

* cited by examiner

*Primary Examiner*—Michael C. Zarroli
*Assistant Examiner*—Phuong Nguyen
(74) *Attorney, Agent, or Firm*—Wei Te Chung

(57) ABSTRACT

An electrical connector includes a connector body (2) having a top wall (220), a bottom wall (222). A terminal (1) has a base section (15) within the body to be moveable longitudinally relative to the body. A pair of spaced retention elements (18) is disposed longitudinally from the base section, and each adjacent the top wall or bottom wall. The retention elements are moveable together with the base section such that when the contact is moved downwards to be at a first position, one of the retention elements is urged to engage on the top wall, and when the contact is moved upwards to be at a second position, the other retention element is urged to engage on the bottom wall, thereby preventing the terminal from being removed during the longitudinal movement of the terminal relative to the body.

6 Claims, 5 Drawing Sheets

ELECTRICAL CONNECTOR WITH CONTACT TERMINAL

BACKGROUND OF THE INVENTION

1. Field of the Invention

The present invention relates to the art of electrical connectors, and more particularly to a contact terminal of an electrical connector having a retention feature for preventing the contact terminal from being removed during movement of the contact terminal relative to a connector body.

2. Description of the Related Art

One conventional contact terminal 1' is shown in FIG. 5. The terminal 1' includes a base section 15' adapted to be positioned within a connector body (not shown) and moveable longitudinally relative to the connector body, a pair of cantilevered contact arm members 10' and 13' extending in opposed directions from the base section 15' with each member including two contact arms, and a contact portion 11' or 13' near a distal region of each arm member for engaging a mating conductive terminal of an electronic component, such as an IC package (not shown). A pair of locating posts 16' is disposed at opposite lateral sides of the base section 15' to assist in the longitudinal movement of the base section 15' relative to the connector body. A problem, however, with the conventional terminal 1' is that the terminal 1' is apt to be removed from the connector body during the longitudinal movement of the terminal 1' relative to the connector body. This is so because there is no proper retention feature on the contact terminal 1' for preventing the terminal 1' from being removed. Therefore, there is a need to provide a new electrical connector having contact terminals therein to resolve the above-mentioned shortcoming.

SUMMARY OF THE INVENTION

An electrical connector according to one embodiment of the present invention includes a connector body and a contact terminal disposed within the connector body. The connector body has a top wall, a bottom wall, and a slot extending from the top wall towards the bottom wall. The terminal is stamped from a sheet of conductive material, and has a base section insertable into the slot and moveable longitudinally within the slot of the connector body. A pair of retention elements is disposed on the base section and spaced longitudinally from each other, each retention element located adjacent the top wall or bottom wall. The retention elements are moveable together with the base section of the contact such that when the contact is moved in a direction from the top wall towards the bottom wall to be at a first position, one of the retention elements is urged to engage on the top wall for positioning the contact relative to the connector body, and when the contact is moved in a direction from the bottom wall towards the top wall to be at a second position, the other retention element is urged to engage on the bottom wall for positioning the contact relative to the connector body. As such, the providence of the retention elements adjacent the top wall and the bottom wall can prevent the terminal from being removed from the connector body during the longitudinal movement of the terminal between the first position, where the upper retention elements engage onto the top wall, and the second position, where the lower retention elements engage onto the bottom wall.

A contact terminal for an electrical connector according to one embodiment of the present invention includes a base section, a pair of cantilevered contact arm members extending in opposed directions away from the base section with each arm member associated with the other arm member away from the base section, a contact portion near a distal region of each arm member, and at least a pair of retention projections extending from the base section and spaced longitudinally from each other. The base section resides in a plane, and is adapted to be positioned within a connector body having a height. Each contact portion extends toward a plane substantially perpendicular to that of the base section of the terminal for engaging a mating conductive terminal. The retention projections has therebetween a distance larger than the height of the connector body, but less than a distance between the contact portions of the arm members, thereby positioning the terminal relative to the connector body by the retention projections during the longitudinal movement of the terminal from a first position to a second position.

Other features and advantages of the present invention will become more apparent to those skilled in the art upon examination of the following drawings and detailed description of preferred embodiments, in which:

DETAILED DESCRIPTION OF PREFERRED EMBODIMENT

Referring to FIGS. 1 to 4, an electrical connector according to the preferred embodiment of the present invention comprises a connector body 2, a plurality of contact terminals 1 resided within the connector body 2. For illustration purposes, merely a part of the electrical connector is shown, with one terminal resided therewithin.

Figure 1:
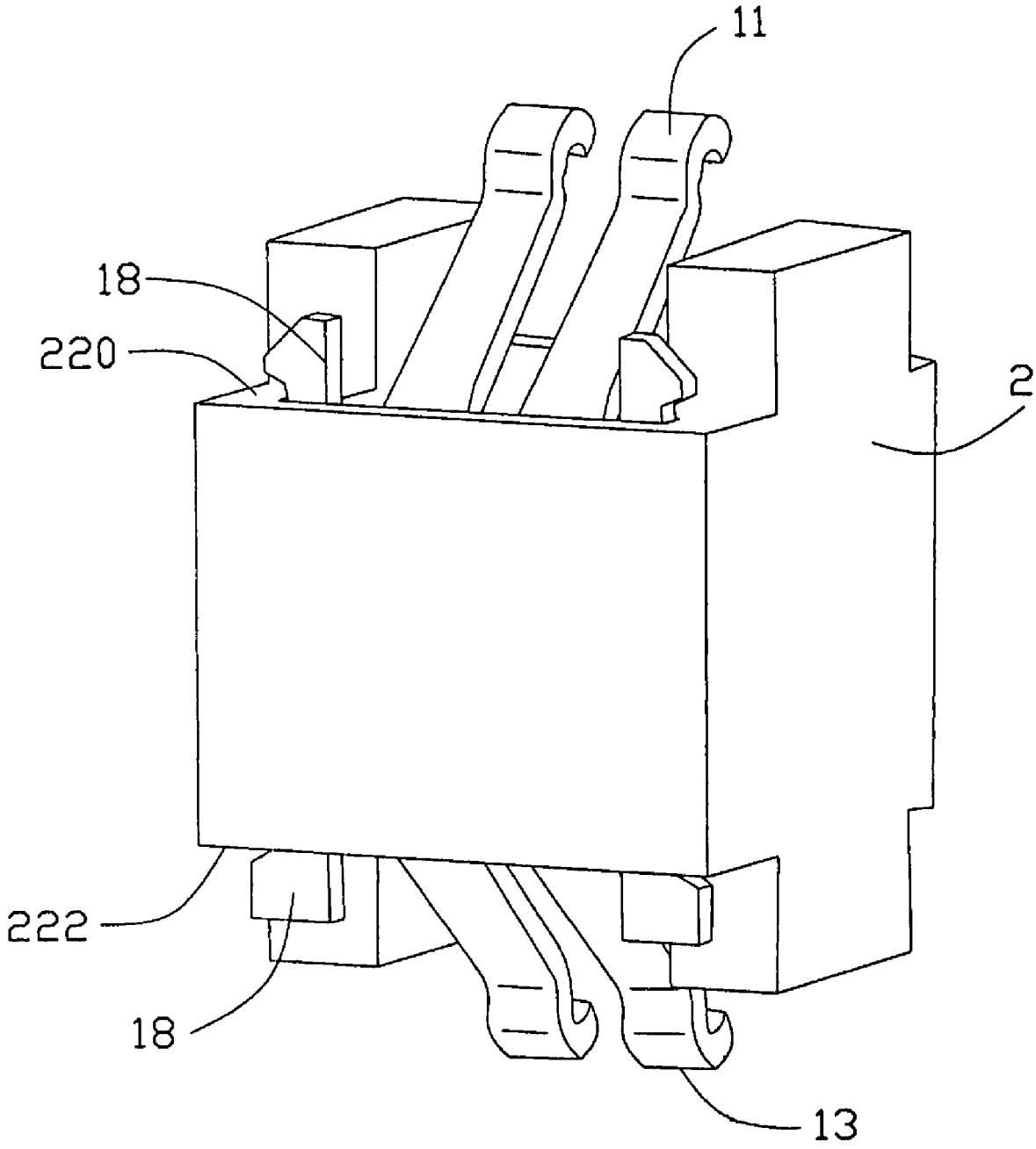
FIG. 1 is an assembled, perspective view of a part of an electrical connector according to a preferred embodiment of the present invention, showing a contact terminal resided therewithin.
Figure 4:
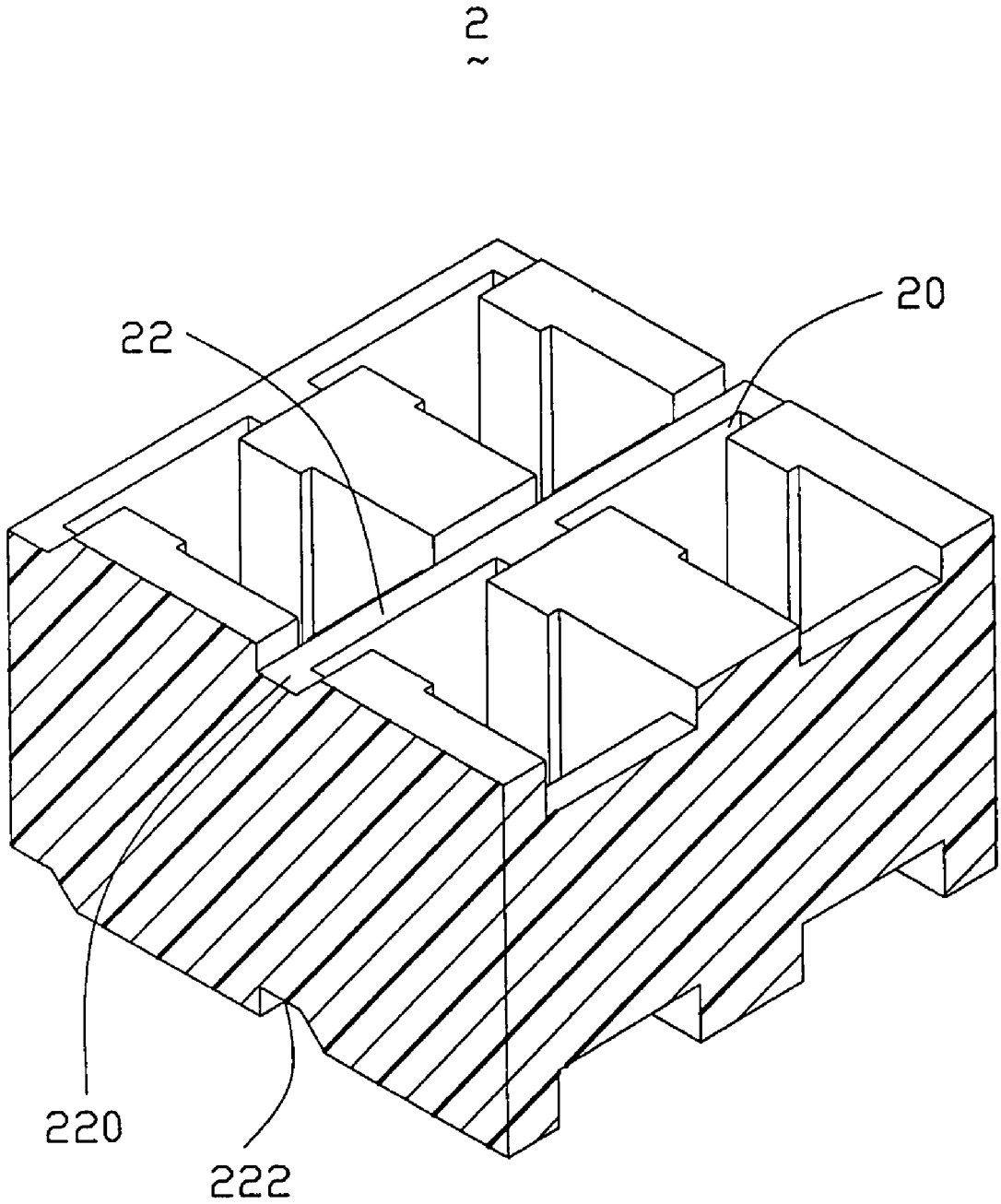
FIG. 4 is a perspective view of a connector body of FIG. 1, which is to receive the terminals therein.
Figure 5:
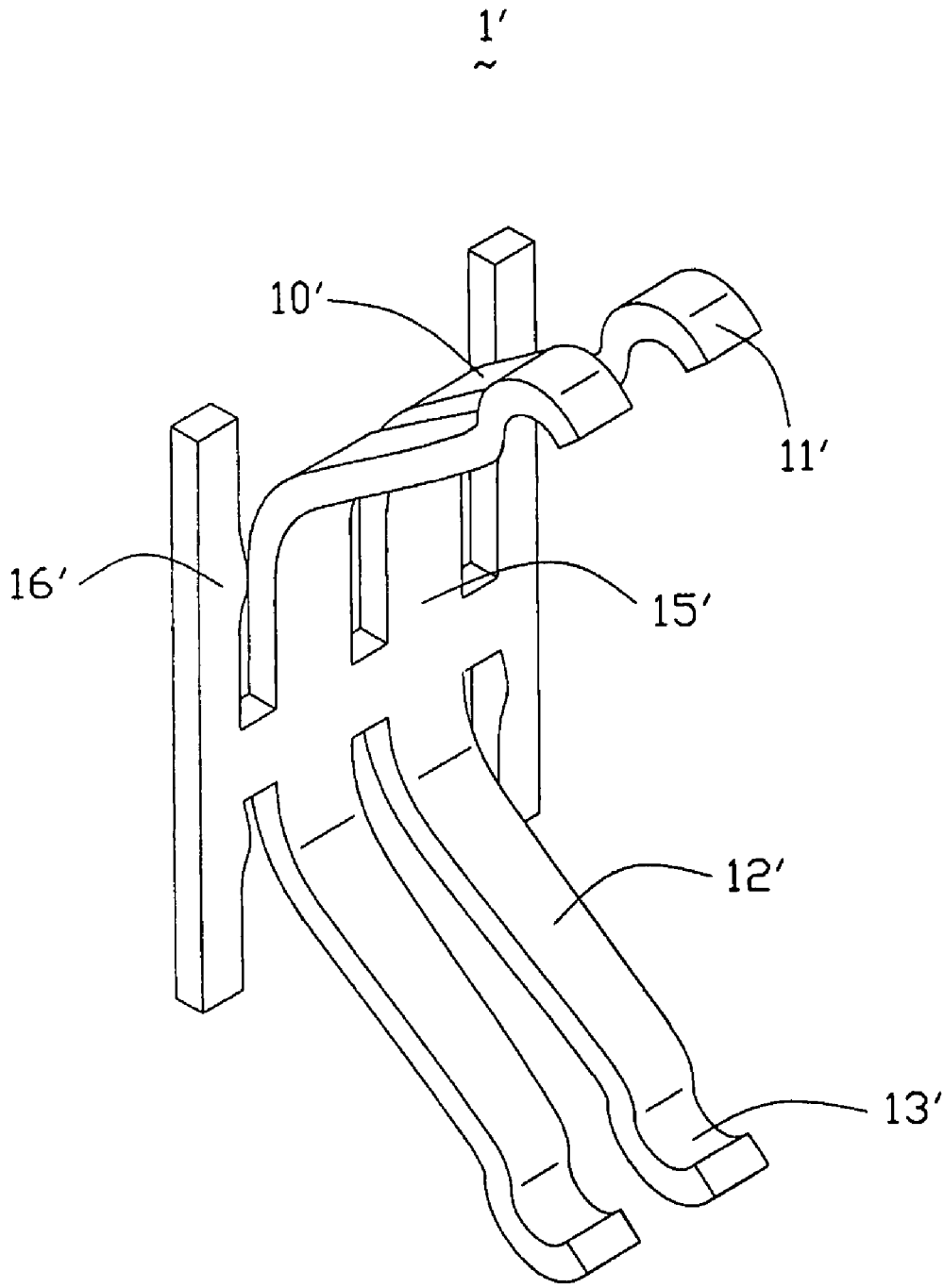
FIG. 5 (PRIOR ART)
FIG. 5 is a perspective view of a conventional contact terminal.

Referring particularly to FIGS. 1 and 4, the connector body 2 includes a base having a recessed part 22 at a rear end thereof. The recessed part 22 has a top wall or side 220 adapted to face a mating component, such as an IC package (not shown), and a bottom wall or side 222 adapted to face a substrate (not shown), and a slot 20 extending from the top wall 220 towards the bottom wall 222 and adapted for receiving a base section 15 of the terminal 1 and allowing the base section 15 of the terminal 1 to be moveable longitudinally within the slot 20 of the connector body 2.

Figure 2:
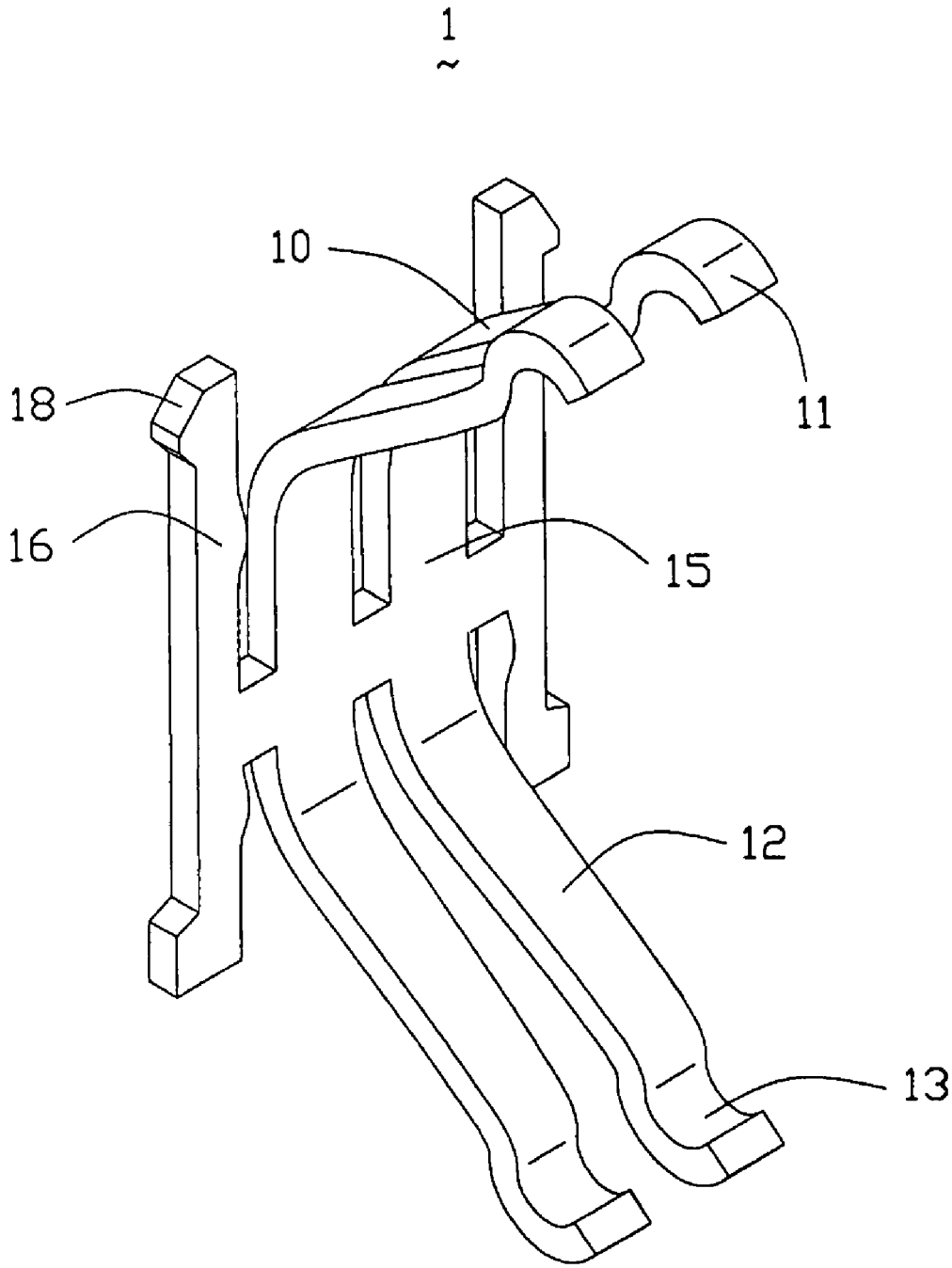
FIG. 2 is a perspective view of the contact terminal of FIG. 1.
Figure 3:
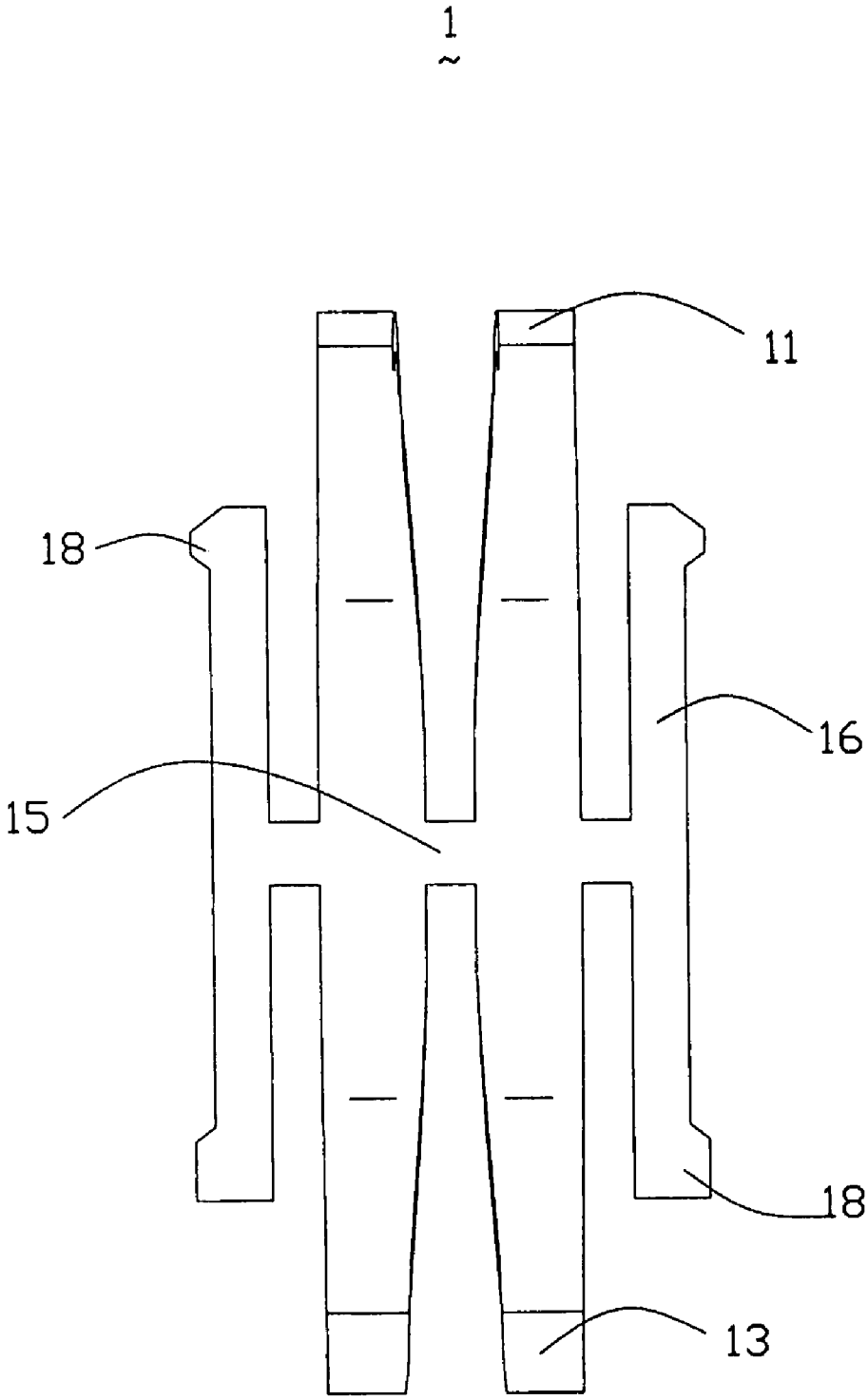
FIG. 3 is a side view of the terminal of FIG. 2.

Referring to FIGS. 2 and 3, the contact terminal 1 is stamped from a sheet of conductive material. The terminal 1 includes a base section 15 residing in a plane and adapted to be disposed within the slot 20 of the connector body 2, and a pair of cantilevered contact arm members 10 and 12 associated with each other and extending in opposed directions away from the base section 15, with each arm member including two cantilevered contact arms spaced laterally from each other. A contact area 11 or 13 is formed near a distal region of each arm member 10 or 12 and configured to extend toward a plane substantially perpendicular to that of the base section 15 of the terminal 1 for engaging a common mating conductive terminal, such as of the IC package or the substrate. Due to having two cantilevered contact arms on each side away from the base section 15, each contact area is provided with two contact sections for engaging the common conductive terminal of the IC package or the substrate. In addition, a pair of locating members 16 is attached to the base section 15 at opposite lateral sides of the base section 15 to assist in the longitudinal movement of the base section 15 along the slot 20 of the connector body 2.

The contact terminal 1 further includes four retention projections 18 on opposite upper and lower ends of each locating member 16, and moveable together with the base section 15 of the terminal 1. That is, each locating member 16 is provided with two limiting or retention projections 18 spaced longitudinally from each other and disposed in an opposed relationship. The two retention projections 18 of each locating member have therebetween a distance larger than a height of the recessed part 22 of the connector body 2, but less than a distance between the contact areas 11 and 13 of the opposite arm members 10 and 13 in order to position the terminal 1 relative to the connector body 2 during the longitudinal movement of the terminal 1 from a first position to a second position (to be later described).

Referring to FIGS. 1, 2 and 4, in assembly, the terminal 1 is positioned within the connector body 2 by inserting the base section 15 into the slot 20. Since the distance between two retention projections 18 of each locating members is larger than the height of the recessed part 22 of the connector body 2, the terminal, in a free form, has two retention projections 18 at the upper ends of the locating members 16 located beyond the top wall 220 of the recessed part 22, and other two retention projections 18 at the lower ends of the locating members 16 below the bottom wall 222 of the recessed part 22.

In use, when the assembled electrical connector is depressed from the side of the IC package to drive the base section 15 of the terminal 1, together with the retention elements 18, moveable downward, i.e. in a direction from the top wall 220 towards the bottom wall 222, to be at the first position, the two retention elements 18 at the upper ends of the locating members 16 are urged to engage on the top wall 220 for positioning the terminal 1 relative to the connector body 2, with the other two retention elements 18 away from the bottom wall 222. In other hands, when the assembled electrical connector is depressed from the side of the substrate to drive the base section 15 of the terminal 1, together with the retention elements 18, moveable upward, i.e. in a direction from the bottom wall 222 towards the top wall 220, to be at the second position, the two retention elements 18 at the lower ends of the locating members 16 are urged to engage on the bottom wall 222 for positioning the terminal relative to the connector body, with the other two retention elements 18 away from the top wall 220. As such, the providence of the retention elements 18 adjacent the top wall 220 and the bottom wall 222 can prevent the terminal 1 from being removed from the connector body 2 during the longitudinal movement of the terminal 1 between the first position, where the two retention elements 18 at the upper ends of the locating members 16 engage onto the top wall 220, and the second position, where the lower retention elements 18 at the lower ends of the locating members 16 engage onto the bottom wall 222.

In this embodiment, the terminal has four retention elements 18 at the upper and lower ends of the locating members 16, respectively. However, in other embodiments, the terminal may have two retention elements located at opposite ends of one locating member, or at opposite ends of two locating members, respectively.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector comprising:

a connector body, the connector body having a top wall and a bottom wall and a slot extending from the top wall towards the bottom wall;

a stamped contact formed from a sheet of conductive material and disposed within the connector body, the contact having a base section insertable into the slot and moveable longitudinally within the slot of the connector body;

said contact comprises a pair of contact arm members extending from the base section in opposed directions;

each contact arm member comprises two cantilevered contact arms spaced laterally from each other;

a pair of locating members is attached to the base section at opposite lateral sides of the base section to assist in the longitudinal movement of the base section along the slot of the connector body;

said contact including at least a pair of retention elements spaced longitudinally from each other, each said retention element located adjacent the top wall or bottom wall, said retention elements moveable together with the base section of the contact such that when the contact is moved in a direction from the top wall towards the bottom wall to be at a first position, one of the retention elements is urged to engage on the top wall for positioning the contact relative to the connector body, and when the contact is moved in a direction from the bottom wall towards the top wall to be at a second position, the other retention element is urged to engage on the bottom wall for positioning the contact relative to the connector body, said at least a pair of retention elements is located at opposite most ends of the lateral side of the base section, respectively;

said contact comprises another pair of retention elements located at an opposite lateral side of the base section.

2. A contact terminal for an electrical connector comprising:

a connector body, the connector body having a top wall and a bottom wall and a slot extending from the top wall towards the bottom wall;

a stamped contact formed from a sheet of conductive material and disposed within the connector body, the contact having a base section insertable into the slot and moveable longitudinally within the slot of the connector body having a height;

each contact arm member comprises two cantilevered contact arms extending from the base section in opposed directions and spaced laterally from each other; a contact portion near a distal region of each arm member for engaging a mating conductive terminal; and a pair of locating members is attached to the base section at opposite lateral sides of the base section to assist in the longitudinal movement of the base section along the slot of the connector body;

at least a pair of retention projections extending from the base section and spaced longitudinally from each other, said retention projections located adjacent the top wall or bottom wall and having therebetween a distance larger than said height, said at least a pair of retention elements is located at opposite most ends of the lateral side of the base section, respectively;

said contact comprises another pair of retention elements located at an opposite lateral side of the base section.

3. The contact terminal of claim 2, wherein said at least a pair of retention projections is adapted to engage on opposite walls of the connector body.

4. An electrical connector comprising:

a connector body, the connector body having a top wall and a bottom wall and a slot extending from the top wall towards the bottom wall;

a stamped contact formed from a sheet of conductive material and disposed within the connector body, the contact having a base section insertable into the slot and moveable longitudinally within the slot of the connector body;

said contact comprises a pair of contact arm members extending from the base section in opposed directions;

each contact arm member comprises two cantilevered contact arms spaced laterally from each other;

a pair of locating members is attached to the base section at opposite lateral sides of the base section to assist in the longitudinal movement of the base section along the slot of the connector body;

said contact including upper and lower limiting elements arranged opposite from each other vertically;

the connector body defining two opposite upper and lower engagement faces respectively confronting the upper and lower limiting elements; wherein a first distance between upper and lower limiting elements is larger than a second distance between the upper and lower engagement faces so as to allow the contact to up-and-down moveable relative to the connector body with a third distance essentially equal to the difference between the first distance and the second distance;

the upper and lower limiting elements are essentially coplanar with each other and located at opposite most end of the lateral sides of the base section.

5. The electrical connector as claimed in claim 4, wherein the connector body defines opposite uppermost and lowermost surfaces which defines a fourth distance larger than the first distance.

6. The electrical connector as claimed in claim 5, wherein the contact further includes opposite upper and lower contacting sections commonly defining a fifth distance larger than the fourth distance.

* * * * *